United States Patent [19]

Smith et al.

[11] 3,948,511

[45] Apr. 6, 1976

[54] SHEET FEEDING DEVICES

[75] Inventors: Vernon J. Smith, Tewkesbury, England; Howard M. Smith, Venray, Netherlands; Bernard F. Page, Coleford, England

[73] Assignee: Rank Xerox Ltd., London, England

[22] Filed: Nov. 19, 1973

[21] Appl. No.: 417,173

[52] U.S. Cl. ..... 271/274; 271/116; 271/125

[51] Int. Cl.[2] ..... B65H 5/06

[58] Field of Search ..... 271/274, 273, 272, 122, 271/125, 116, 34, 35

[56] References Cited

UNITED STATES PATENTS

| | | | |
|---|---|---|---|
| 2,036,919 | 4/1936 | Calmes | 271/125 |
| 3,032,338 | 5/1962 | Anderson et al. | 271/125 X |
| 3,073,590 | 1/1963 | Romeo et al. | 271/274 |

FOREIGN PATENTS OR APPLICATIONS

| | | | |
|---|---|---|---|
| 1,263,340 | 5/1961 | France | 271/274 |

*Primary Examiner*—John J. Love
*Assistant Examiner*—Bruce H. Stoner, Jr.
*Attorney, Agent, or Firm*—Earl T. Reichert

[57] ABSTRACT

A plurality of first rollers are rotatably mounted on a shaft symmetrically about the center of the shaft. The shaft is biased toward an axis about which a plurality of second rollers are mounted for rotation so that the first and second rollers contact each other. The shaft is supported for movement in a plane toward and away from the axis, and for rotation about an axis through the center of the shaft at right angles to the plane. A drive mechanism is provided for driving either the first or second rollers to forward a sheet between the nip of the rollers.

1 Claim, 6 Drawing Figures

SHEET FEEDING DEVICES

BACKGROUND OF THE INVENTION

This invention relates to feeding sheets between a pair of rollers.

When feeding articles such as punched cards or envelopes which are only a few inches wide, a single pair of rollers of about one inch in width has been found sufficient to forward the articles along their path.

We have discovered that it is not possible to forward very wide sheets between a pair of rollers of this size, as the sheets very easily become skewed so that they do not follow the desired sheet feed path. A pair of very long rollers would be ruled out on the grounds of cost.

In accordance with the present invention, we provide a plurality of rollers mounted on a shaft and forming a nip with a second roller or rollers mounted for rotation about an axis substantially parallel to said shaft, together with other features which will be described below.

It is usual to form the driving surfaces of such feed rollers of resilient material in order to increase friction between the rollers and the sheet, and we have found it convenient to form such surfaces by moulding onto a central shaft or central bearing to fit on a shaft. It is difficult to mould such rollers with their surfaces accurately concentric with the shaft or bearing, so that two pairs of rollers formed in this way may provide an uneven drive to a sheet fed between the rollers of the pairs.

In order to accommodate sheets of different thicknesses and to provide an approximately constant pressure between the rollers of a pair whatever the thickness of a sheet passing between them, it has been proposed to mount the shaft carrying one pinch roller for movement towards and away from the shaft carrying the other pinch roller of a pair and to bias the two shafts together. British Patent Specification No. 922780 discloses in FIG. 3 such an arrangement, but in connection with a single pinch roller in the form of a friction disc with a spring mounting at each end of the shaft supporting the friction disc. This arrangement has been tried in connection with a plurality of sets of pinch rollers mounted across the width of a wide sheet, but it has been found that with moulded pinch rollers which may not be accurately concentric, feeding of a wide sheet without skewing is impossible.

SUMMARY OF THE INVENTION

According to the invention there is provided a sheet feeding device comprising a plurality of first rollers mounted on a shaft symmetrically about the center of the shaft, a second roller or rollers mounted for rotation about an axis substantially parallel to said shaft, means for supporting said shaft for movement towards and away from said axis, biasing means acting on the center of the shaft to bias the shaft towards said axis, and drive means for driving the first or second rollers to forward a sheet between the nip of the rollers. This movement towards and away from said axis allows sheets of different thicknesses to pass between the first and second rollers, and even a plurality of sheets to pass between them simultaneously.

The shaft supporting means preferably supports the shaft for movement in a plane towards a away from said axis, and for rotation about an axis through the center of the shaft at a right angle to said plane. The shaft can thus rock about its center to accommodate differences in the radii of the rollers, thus making the pressure between the rollers more uniform, so that a wide sheet fed between the nip of the rollers will be fed forward without skewing.

An example of the invention will now be described in which the rollers are used in a separator assembly, the drive means being applied to the second rollers of which there are two, the first rollers of which there are also two located exactly opposite the second rollers being anchored against rotation through a slip clutch. The slip clutch will slip when there is no sheet or only one sheet in the nips of the rollers as the friction between the rollers or between the rollers and a single sheet will transfer a sufficient torque from the drive means to the slip clutch to cause it to slip. However, when there are two or more sheets in the nip of the rollers, the friction between adjacent sheets will be insufficient to transfer a torque to the clutch to cause it to slip, so that the first rollers will remain stationary, thus retaining the second and any subsequent sheets at the nip of the rollers, leaving the first sheet to be forwarded by the sheet feeding device. The application of the biasing means to the center of the shaft is particularly effective when there are two first rollers and two second rollers, as any non-uniformity in a roller can cause the shaft to skew about the axis without being restrained by another pair of rollers on the same side of the center of the shaft.

Figure 1:
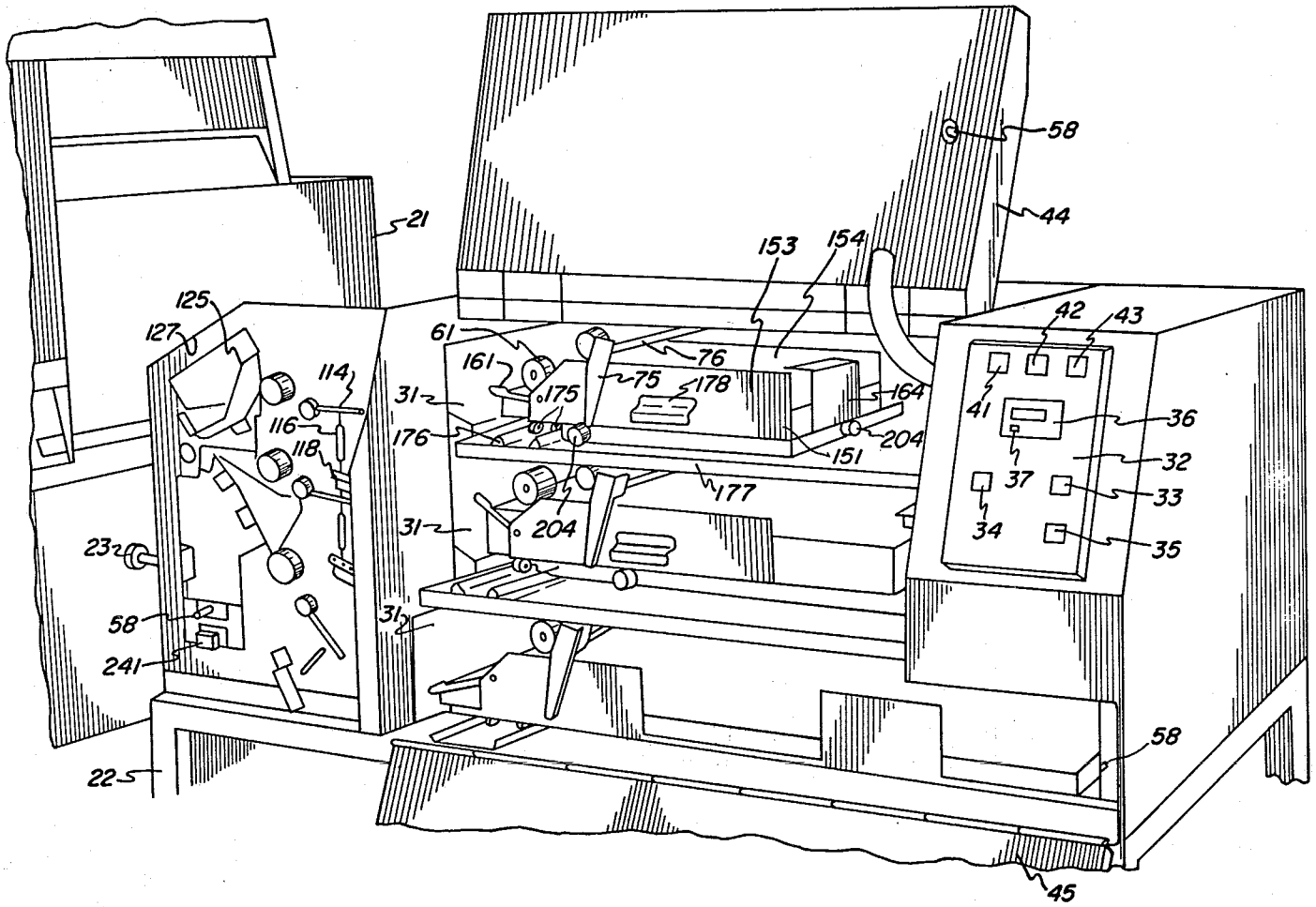
FIG. 1 is a perspective view of sheet feed apparatus with some parts of its cabinet removed and some cabinet doors opened.

The sheet feeding apparatus shown in the drawings is intended for feeding cut sheets of different sizes into a main copying machine 21, which forms xerographic images of an original on the sheets. The apparatus is mounted on a wheeled frame 22 and is provided with buffers 23 which keep the apparatus from approaching the main copying machine too closely. A docking clamp and electrical connector (not shown) are provided between the apparatus and the main copying machine.

The central portion of the apparatus as seen in FIG. 1 contains three compartments 31, supporting paper trays 151 for three sizes of sheet. Inside the top of each paper tray compartment 31, there is provided a feed roller assembly, including a pair of feed rollers 61. These rollers are driven by means of an electromagnetic clutch controlled by the machine logic. A three-way switch (not shown) controls the machine logic to actuate the feed rollers 61 in a selected compartment 31.

Figure 2:
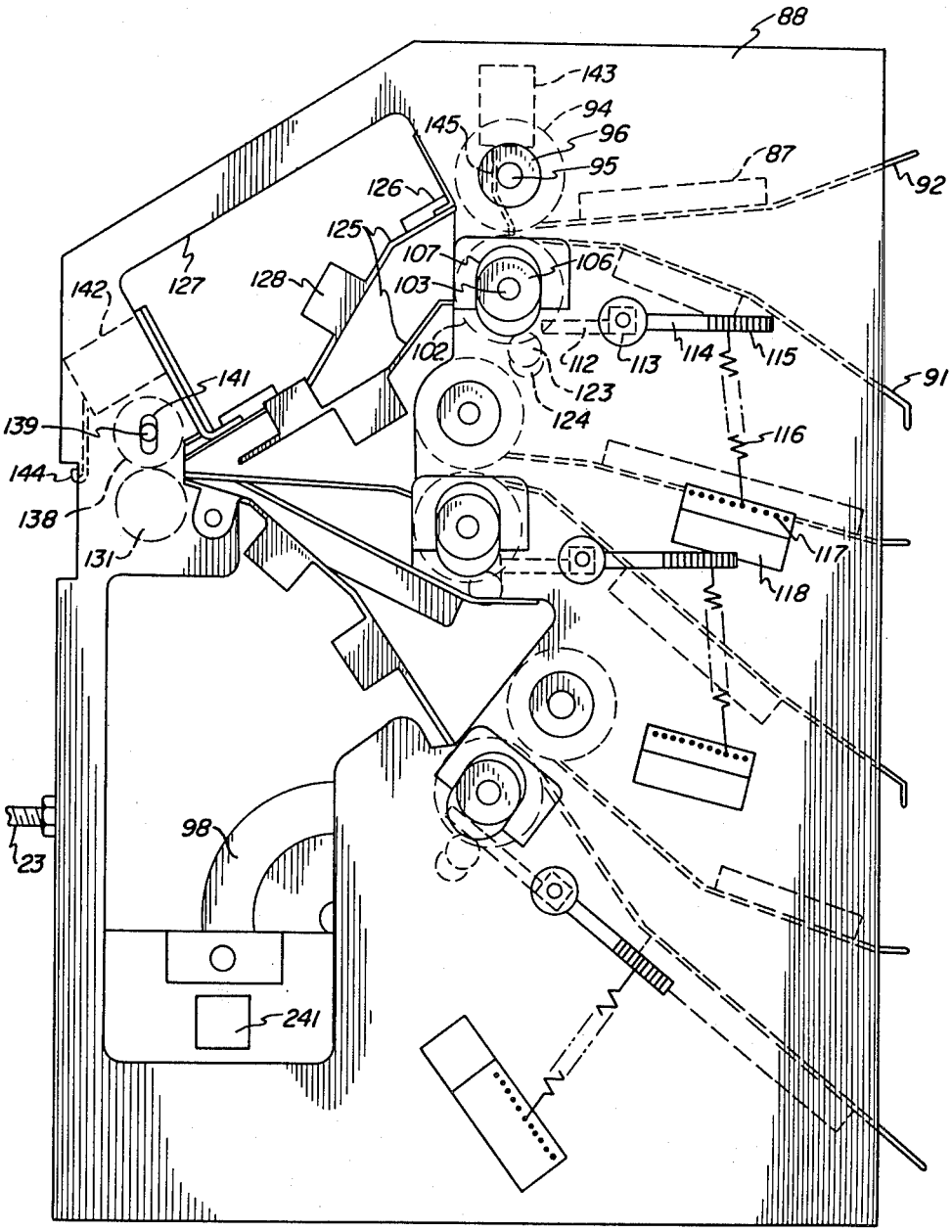
FIG. 2 is a side elevation of the left hand portion of the apparatus of FIG. 1.
Figure 3:
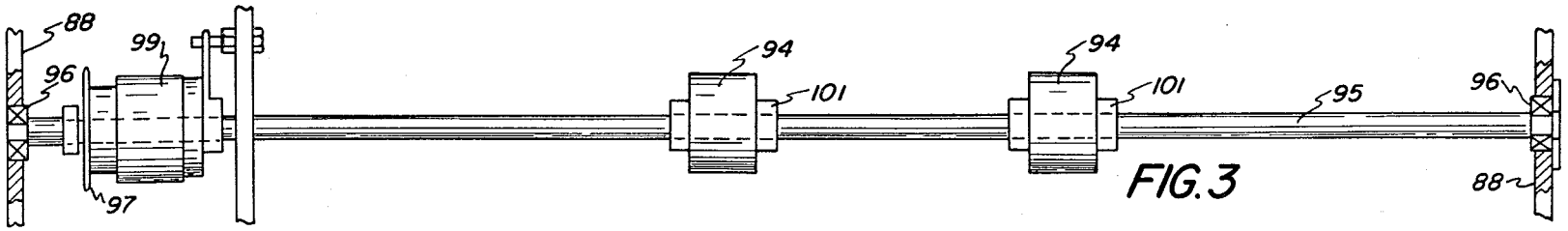
FIG. 3 is a side elevation of a shaft from FIG. 2, showing the components mounted upon it.
Figure 4:
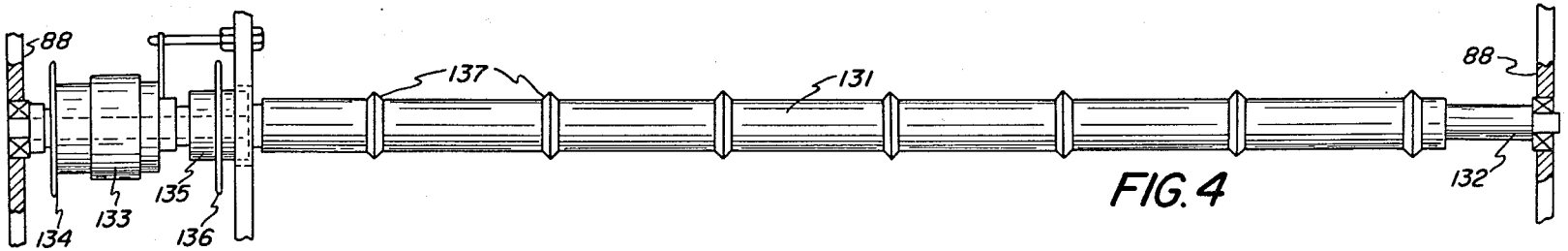
FIG. 4 is a side elevation of another shaft of FIG. 2, showing the components mounted upon it.
Figure 5:
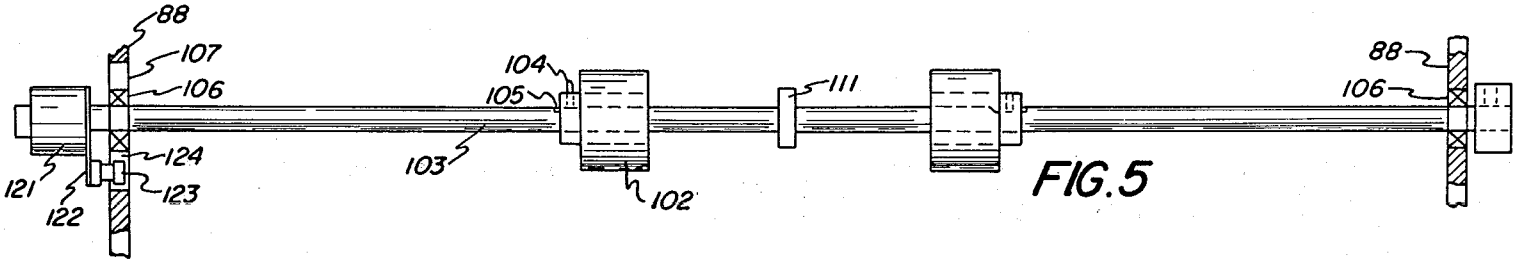
FIG. 5 is a side elevation of a further shaft in FIG. 2, showing the components mounted upon it.
Figure 6:
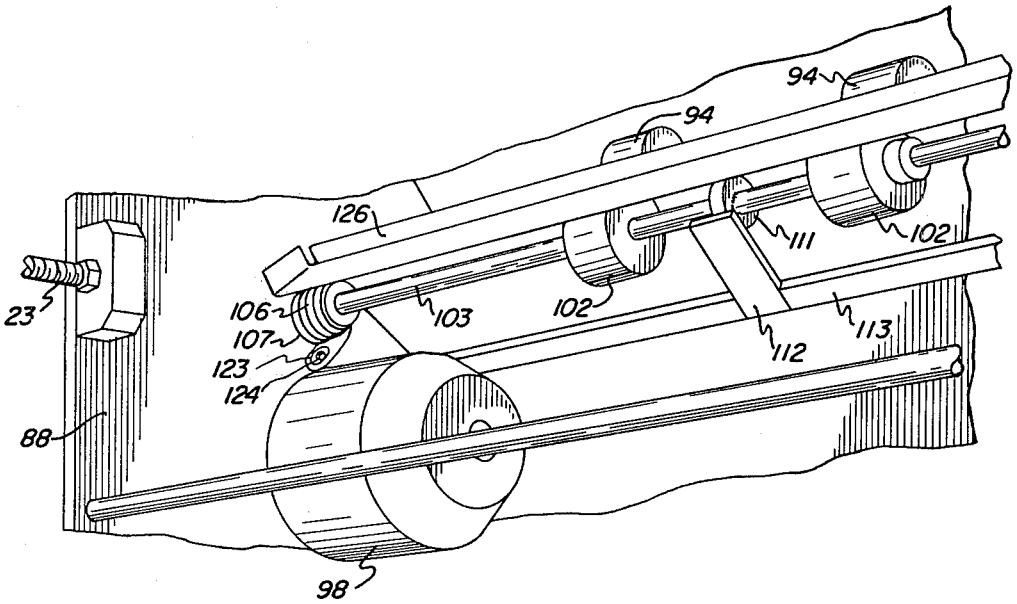
FIG. 6 is a perspective view of part of the apparatus of FIG. 2, with certain components removed for clarity.

The selected feed roller assembly feeds sheets into the corresponding sheet feed path as shown in FIG. 2 commencing on the right hand side of the figure and ending at a common point for all three paths on the left hand side of the figure. The three paths corresponding to the three compartments 31 resemble each other, and only one will be described. The start of each path is formed by two baffle plates 91 and 92, whose spacing becomes progressively smaller as the distance from the right hand side of the figure increases. The baffle plates are formed with planar sections which are inclined to each other. All the sections of the lower plate 91 are upwardly inclined in the direction of sheet travel and the sheet from the compartment will strike the lower plate 91 and be guided upwardly along the path by the lower plate 91. The baffle plates are fixed by means of brackets 87 to the side plates 88 of the apparatus.

The left hand end (as seen in FIG. 2) of each pair of baffle plates 91 and 92 feeds into the nip of a separator roller assembly. The assembly comprises two pairs of knurled polyurethane surfaced rollers for high coefficient of friction, the upper roller 94 of each pair being mounted on a shaft 95 journalled in fixed bearings in the side plates of the apparatus. The shaft 95 is driven from a sprocket engaging a common drive chain driven by a main drive motor 98 through an electromagnetic clutch 99 controlled by the machine logic. The rollers 94 are driven in the clockwise direction seen in FIG. 2 by the shaft 95, but are provided with overrunning clutches 101 so that they can rotate clockwise as seen in FIG. 2, relative to the shaft. Overrunning will occur when a sheet is pulled out faster than the rollers 94 are being driven.

The lower rollers 102 of the two pairs in the separator roller assembly are mounted opposite the respective upper roller on a shaft 103 for rotation therewith by a screw 104 engaging a recess 105 in the shaft 103. The shaft 103 is journalled in bearings 106 mounted in slots 107 in the side plates of the apparatus, the slots being elongated along the line joining the two shafts 95, 103. The lower shaft 103 can therefore move towards and away from the upper shaft 95, but cannot move in the tangential direction. It can also move out of parallel to the shaft 95 if a different thickness of sheet appears between the two pairs of rollers or if the rollers 94 should be non-concentric with the shaft 95.

The lower roller shaft 103 is biased towards the upper roller shaft 95 by a biasing system acting on a ballrace 111 at the center of the lower shaft. The rollers 102 are equidistant from the ballrace 111. The biasing system comprises a lever 112 extending from a square-section shaft 113 journalled in the side plates of the apparatus, a second lever 114 extending from the end of said shaft oppositely to the lever 112 and outside the side plate 88. The lever 114 is provided with a series of annular recesses 115 along its length, and a spring 116 extends from one of the recesses to one of a series of holes 117 on a bracket 118 mounted on the outside of the side plate 88. The appropriate recess 115 and hole 117 are chosen for securing the ends of the spring 116 in order to provide a desired bias to the lower shaft 103.

The lower shaft 103 of the separator roller pair is anchored to the side plate 88 through a mechanical slip clutch 121. A frame anchor is provided by a plate 122 keyed to the clutch 121 and carrying an auxiliary roller 123 movable in a narrow slot 124 extending from the lower end of the slot 107 in the side plate in which the bearing 106 of the lower shaft 103 move. The anchoring roller 123 can therefore move towards and away from the upper shaft 95 with the lower shaft 103, but prevents the plate 122 from rotating relative to the side plate 88. The mechanical slip slutch 121 is set to slip at a predetermined torque.

In an alternative arrangement not shown, an electrical slip clutch is provided, which will slip at a torque determined by the current applied to the clutch. Adjustment of this clutch is by changing the current supplied to it, whereas adjustment of a mechanical slip clutch will require physical access of at least a tool to the slip clutch, which is often not possible in a compact machine without disassembly of several components. A sensing device (not illustrated), such as a microswitch can be provided to operate the "paper jam" alarm and shut down the machine if the shaft 103 is moved by an excessive amount away from the upper shaft 95, as when a very large number of sheets are fed simultaneously between the rollers 94, 102 which might not be properly separated by the separator roller assembly.

On the left hand side of the separator roller sets (as seen in FIG. 2), further baffle plates 125 are provided with guide sheets from the three separator roller assemblies to a common drive roller assembly. The additional baffle plates 125 are slidably mounted on rails 126 secured between the side plates 88, and can be withdrawn through an aperture 127 in the side plate by means of lugs 128 in order to clear a paper jam. The upper and lower baffle plates are slidably mounted at each side, but the central baffle plates are mounted on rails at their right hand ends only, as the sheet paths merge at their left hand ends and mounting rails would obstruct these paths. Instead the left hand ends of the baffles 125 are supported at their front and rear edges on brackets (not shown).

The lower roll 131 of the drive roll assembly is mounted on a shaft 132 journalled as fixed positions in the side plates 88 of the apparatus. The shaft 132 is driven through an electromagnetic clutch 133 from a sprocket 134 driven by the common drive system of the apparatus, and a mechanical overrunning clutch 135 is also mounted on the shaft 132 driven by a sprocket 136 of a slower speed drive system. The roll 131 is provided with a number of resilient bands 137 along its length in order to increase the driving power of the roller. The upper roll 138 of the assembly is mounted on a shaft 139 supported in vertically extending slots 141 in the side plates 88 above the drive roll 131 and is of metal with a smooth surface. The roll 138 presses down on to the bands 137 so that any sheet therebetween will be driven forward when the roll 131 is rotated. The weight of the roll 138 biases it towards the drive roll 131.

Two microswitches 142, 143 sense the passage of sheets through the apparatus of FIG. 2. An actuating arm 144 of the first microswitch 142 is located in the path of sheets emerging from the drive roller assembly. The second microswitch is located with its actuating arm 145 adjacent the exit from the top set of separating rollers only. Both microswitches are connected into the machine logic. The microswitch 142 on actuation causes the machine logic to de-energize the electromagnetic clutches 73, 99 of the separator roller assembly and feed rollers which had previously been energized. The microswitch 143 when actuated causes the machine logic to de-energize the electromagnetic clutch 73 in the drive to the feed rollers in the upper compartment only. The microswitch 143 is provided in the upper sheet feed path only, as this path is intended for short sheets whose trailing edge will have left the feed rollers 61 before the leading edge reaches the actuating arm 144 of microswitch 142.

When the appropriate feed rollers 61 are driven, the top sheet from the stack in that compartment will enter the appropriate path between the baffle plates 91 and 92 opposite the compartment in which the stack is situated. The sheet will strike the lower plate 91, which is inclined upwardly, so that the sheet will be guided upwards to the nip of the separator roller assembly, facilitating the task of the separator roller assembly, since when two or more sheets are fed together, the upwards guiding will tend to cause the leading edge of the upper sheet to be in advance of the leading edges of the lower sheets.

The sheet will pass between the nip of the separator rollers 94, 102 and be guided by the baffle plates 125 between the nip of the drive rollers 131, 138 and out of the left hand side of the apparatus shown in FIG. 1. As the leading edge of the sheet emerges from the drive roller assembly, it will actuate the finger 144 of microswitch 142, which will cause the machine logic to de-energize the electromagnetic clutches 73, 99 of the separator roller assembly and the feed rollers of the appropriate feed path which had previously been energized. Although the sheet may still be present under the feed rollers and between the rollers of the separator assembly, the drive will be taken over by the drive rollers alone, and the upper roller 94 of the separator roller assembly and feed rollers 61 will overrun by virtue of their overrunning clutches.

If two or more sheets should be fed forward by the feed rollers 61 in spite of the separating action of the snubbers 161 at the front corners of the stack, the separator rollers 94, 102 are designed to feed forward only the top sheet and to retain the second and any further sheets from proceeding beyond the separator rollers. The knurled texture of the polyurethane covering of the rollers 94 and 102 and the bias exerted by the spring 116 to urge the rollers together is such that when no sheet or only one sheet is present between the rollers 94 and 102, the lower roller 102 is urged to rotate anticlockwise as seen in FIG. 2 by friction between the rollers and the sheet if present. However, when two or more sheets are present between the rollers, the torque exerted on the lower roller 102 by the friction between the plurality of sheets present between the rollers is insufficient to cause the slip clutch 121 to slip. The lower roller 102 and the sheet or sheets immediately adjacent to it therefore remain stationary, and only the sheet immediately adjacent the top roller 94 proceeds forward. As soon as this forwarded sheet reaches the finger 144 of microswitch 142, the drive to the roller 94 will be stopped so that the remaining sheet or sheets will remain between the separator roller assembly. The drive to the roller 94 will be continued after the trailing edge of the first sheet has passed the finger 144 of microswitch 142 and when the main copying machine 21 sends a signal to the machine logic that a further sheet is to be fed so that the sheet immediately adjacent to the roller 94 will be forwarded, and any remaining sheets will be retained as previously described. In the lower two compartments, the sheets retained at the separator roller assembly are long enough to extend under the feed rollers 61, so that when the separator rollers and the feed rollers are restarted when the machine 21 is ready after the trailing edge of the first sheet has passed the finger 144 of microswitch 142, no further sheets will be fed forward from the stack until all the multiply fed sheets have been cleared from the separator roller assembly. In the top feed path, the provision of microswitch 143 will prevent any further forwarding of sheets from the top of the stack by the feed rollers 61 in the top compartment.

The biasing arrangement of the spring 116 on the lower roller 102 allows the lower roller to move away from the upper roller 94 when a larger thickness of sheets passes between them. If this movement were not allowed, the reaction between the two rollers 94, 102 might increase on passage of multiple sheets to such an extent that the friction between adjacent sheets of the multiply fed sheets would be sufficient to exceed the maximum torque exerted by the slip clutch 121, so that sheets would then be fed forward together past the drive roller 121 and into the main copying machine 21 thus causing a paper jam.

When a paper jam is indicated by the lamp 142 on the control panel, the machine will shut down and cannot be restarted before depressing a button 241 on the side plate 88 of the apparatus shown in FIG. 1. This button 241 is connected to a two-unit solenoid device (not shown) in the machine logic, such that the solenoid must be re-set by depressing the button 241 each time a jam is indicated before the machine can be restarted. In order to gain access to this button 241, the operator will have to open the door (not shown) in front of the plate 88, and will then be able to view the space on both sides of the separator rollers 94, 102. If the paper jam is visible on the left hand side of the separator rollers, the appropriate baffles 125 can be removed by sliding them forward through the aperture 127 in order to gain access to the jammed sheets and to remove them. The baffle plates 125 are then replaced, the button 241 depressed and the cabinet door closed before starting the apparatus again. If the jammed paper is seen to the right of the separator roller assemblies, the appropriate paper tray 151 will have to be withdrawn from its compartment 31 in order to gain access to the space between the baffle plate pairs 91 and 92. Thus, it is not possible for the operator merely to press the start button, again when the machine has shut down after a paper jam, but the cabinet door in front of the apparatus shown in FIG. 2 must first be opened to depress the button 241 which will make the possible places in which a jam might occur visible and so that jam is more likely to be cleared even by a careless operator.

What we claim is:

1. A sheet feeding device comprising a plurality of first rollers mounted on a shaft symmetrically about the center of the shaft, a plurality of second rollers opposite the first rollers mounted for rotation about an axis substantially parallel to the shaft, means comprising a frame having a slot formed therein at each end of the shaft for supporting the shaft for movement in a plane toward and away from the axis and for rotation about an axis through the center of the shaft at right angles to the plane, means acting on the center of the shaft for biasing the shaft toward the axis, the biasing means comprising a lever and a ballrace, means including an overrunning clutch for driving the second rollers, a slip clutch having two members which will slip when a torque greater than a predetermined value is applied between them, and means for anchoring one of the members against rotation, the other of the members being connected for rotation with the first rollers.

* * * * *